US006222143B1

(12) United States Patent
Lawson et al.

(10) Patent No.: US 6,222,143 B1
(45) Date of Patent: Apr. 24, 2001

(54) POSITIVE OFF TOGGLE MECHANISM

(75) Inventors: Robert P. Lawson, Snellville; Andrew Hall, Lilburn, both of GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/507,195

(22) Filed: Feb. 18, 2000

(51) Int. Cl.[7] ..... H01H 23/00
(52) U.S. Cl. ..... 200/401; 335/167
(58) Field of Search ..... 200/401; 335/23–25, 335/167–176, 16, 147, 195; 218/22

(56) References Cited

U.S. PATENT DOCUMENTS

| | | | | |
|---|---|---|---|---|
| 5,117,210 | * | 5/1992 | Castonguay et al. | 335/172 |
| 5,120,921 | * | 6/1992 | DiMarco et al. | 200/401 |
| 5,165,532 | | 11/1992 | Pipich et al. | 200/401 |
| 5,184,717 | * | 2/1993 | Chou et al. | 200/401 |
| 5,213,206 | * | 5/1993 | Beck et al. | 200/401 |
| 5,260,533 | * | 11/1993 | Livesey et al. | 200/401 |
| 5,270,564 | | 12/1993 | Parks et al. | 200/401 |
| 5,290,982 | * | 3/1994 | Beck et al. | 200/401 |
| 5,296,664 | * | 3/1994 | Crookston et al. | 200/401 |
| 5,418,343 | * | 5/1995 | Faber et al. | 200/401 |
| 5,543,595 | | 8/1996 | Mader et al. | 200/401 |
| 5,762,182 | * | 6/1998 | Faber | 200/401 |

* cited by examiner

*Primary Examiner*—Michael L. Gellner
*Assistant Examiner*—Nhung Nguyen

(57) ABSTRACT a A positive OFF toggle mechanism 402 is disclosed for a circuit breaker having "ON", "OFF," and "TRIPPED" conditions and corresponding handle positions. The circuit breaker 10 includes a pair of contacts 44, one of which is coupled to an operating mechanism 40 having a pivoting member 13. The positive OFF toggle mechanism 402 includes a lower toggle member 404 having a first end 412 operatively coupled to the contact 44 coupled to the operating mechanism 40 and a second end 408 coupled to a toggle pivot pin 416*a*; an upper toggle member 410 having a first end 412 coupled to the toggle pivot pin 416*a* and a second end 408 in operative contact with a toggle pin mounted on the operating mechanism 40. The positive OFF circuit breaker further includes a catch member mounted on the pivoting member of the operating mechanism 40, with the catch member arranged to engage the second end 408 of the upper toggle 410 when the circuit breaker 10 is in the TRIPPED condition and the pair of contacts remain together.

17 Claims, 5 Drawing Sheets

POSITIVE OFF TOGGLE MECHANISM

FIELD OF THE INVENTION

The present invention relates generally to the field of electrical circuit breakers, and more particularly to a circuit breaker which indicates an OFF condition only when contacts are separated.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as several thousand amps. The tripping mechanism for the breaker usually consists of a thermal overload release and a magnetic short circuit release. The thermal overload release operates by means of a bi-metallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross-section and related elements are specifically selected for such current range resulting in a number of different circuit breakers for each current range.

On occasion, one or more movable contacts may be inadvertently welded to their respective stationary contacts due to, for example, excessive arcing or overcurrent. When this happens, it is desirable for the handle to not be positionable in the OFF position as to do so would mislead workers into believing that equipment and circuits connected to the load terminals of the circuit breaker were not electrically powered when, in fact, they would be.

Thus, there is a need for a circuit breaker to have a handle which is not positionable in an OFF position when contacts are welded together. There is also a need for a circuit breaker to have a positive "OFF" handle position to alert a worker that the contacts are welded together, or are otherwise inseparable.

SUMMARY OF THE INVENTION

The present invention provides a positive "OFF" toggle mechanism for a molded case circuit breaker having "ON", "OFF", and "TRIPPED" conditions and corresponding handle positions. The circuit breaker includes a pair of contacts, one of which is coupled to an operating mechanism having a pivoting member. The positive "OFF" toggle mechanism includes a lower toggle member having a first end operatively coupled to the contact coupled to the operating mechanism and a second end coupled to a toggle pivot pin; an upper toggle member having a first end coupled to the toggle pivot pin and a second end in operative contact with a toggle pin mounted on the operating mechanism. The positive "OFF" circuit breaker further includes a catch member mounted on the pivoting member of the operating mechanism, with the catch member arranged to engage the second end of the upper toggle when the circuit breaker is in the welded condition and the pair of contacts remain together.

The present invention also provides a positive "OFF" toggle mechanism for a circuit breaker having an operating mechanism including a handle and a moveable contact arm, a trip bar, a line terminal, a load terminal and a cover. The positive "OFF" toggle mechanism includes a lower toggle bar, having a first and a second end, with the first end pivotally coupled to the movable contact arm. The toggle mechanism further includes an upper toggle bar, having a first end and a second end, with the second end pivotally coupled to the second end of the lower toggle bar and with the first end of the upper toggle bar having a cam finger. A pivot pin is mounted on the operating mechanism and aligned to engage the first end of the upper toggle bar. The toggle mechanism further includes a handle arm associated with the handle, with the handle arm having a cam surface aligned to selectively engage the cam finger of the upper toggle bar when the operating mechanism is in a welded position and the movable contact arm has not moved, wherein the operating mechanism is prevented from being moved to an "OFF" position.

The present invention further provides a molded case circuit breaker including a molded housing provided with a removable breaker cover, a first terminal and a second terminal mounted in the case, a contact electrically coupled to the first terminal, a moveable contact electrically coupled to the second terminal, and an operating mechanism having a pivoting member moveable between an "ON" position, an "OFF" position and a "TRIPPED" position, wherein the pivoting member is coupled to the moveable contact. The circuit breaker also includes an intermediate latching mechanism mounted in the housing and coupled to the operating mechanism, a trip unit having a trip bar and coupled to the moveable contact and the second terminal with the trip unit in selective operative contact with the intermediate latching mechanism; and an accessory socket formed in the removable breaker cover on either side of an opening for the pivoting member; with the accessory socket in communication with the housing and configured to accept a plurality of different types of accessories. The circuit breaker further includes an accessory cover sized to cover the accessory mounted in the accessory socket, and a positive "OFF" toggle mechanism. The positive "OFF" toggle mechanism includes a lower toggle bar having a first and a second end, with the first end pivotally coupled to the movable contact arm; an upper toggle bar, having a first end and a second end, with the second end pivotally coupled to the second end of the lower toggle bar and with the first end of the upper toggle bar having a cam finger; a pivot pin mounted on the operating mechanism with the pivot pin aligned to engage the first end of the upper toggle bar; and a handle arm associated with the handle. The handle arm is provided a cam surface aligned to selectively engage the cam finger of the upper toggle bar when the operating mechanism is in a tripped position and the movable contact arm has not moved, wherein the operating mechanism is prevented from being reset.

The present invention still further provides a circuit breaker including a molded housing including a base and a cover, a means for connecting a load to the circuit breaker, mounted in the housing; a means for connecting an electrical line to the circuit breaker; and a means for coupling electrically to the means for connecting an electrical line. The circuit breaker also includes a movable means for contacting the means for connecting an electrical line to a means for operating mounted in the housing coupled with the means for operating having a pivoting member movable between an "ON" position, an "OFF" position, and a "TRIPPED" position, with the pivoting member coupled to the movable means for contacting and with the means for operating coupled to an intermediate means for latching the means for operating. The circuit breaker further includes a means for tripping coupled to the movable means for contacting and the means for connecting a load with the intermediate means for latching, wherein the means for tripping includes a means for releasing under a short circuit condition and a means for releasing under an overload condition; and a means for preventing the pivoting member from moving to the "OFF" or a reset position when the movable means for contacting has not moved and the means for operating is in the "TRIPPED" position.

DETAILED DESCRIPTION OF THE PREFERRED EMBODIMENTS

Figure 1:
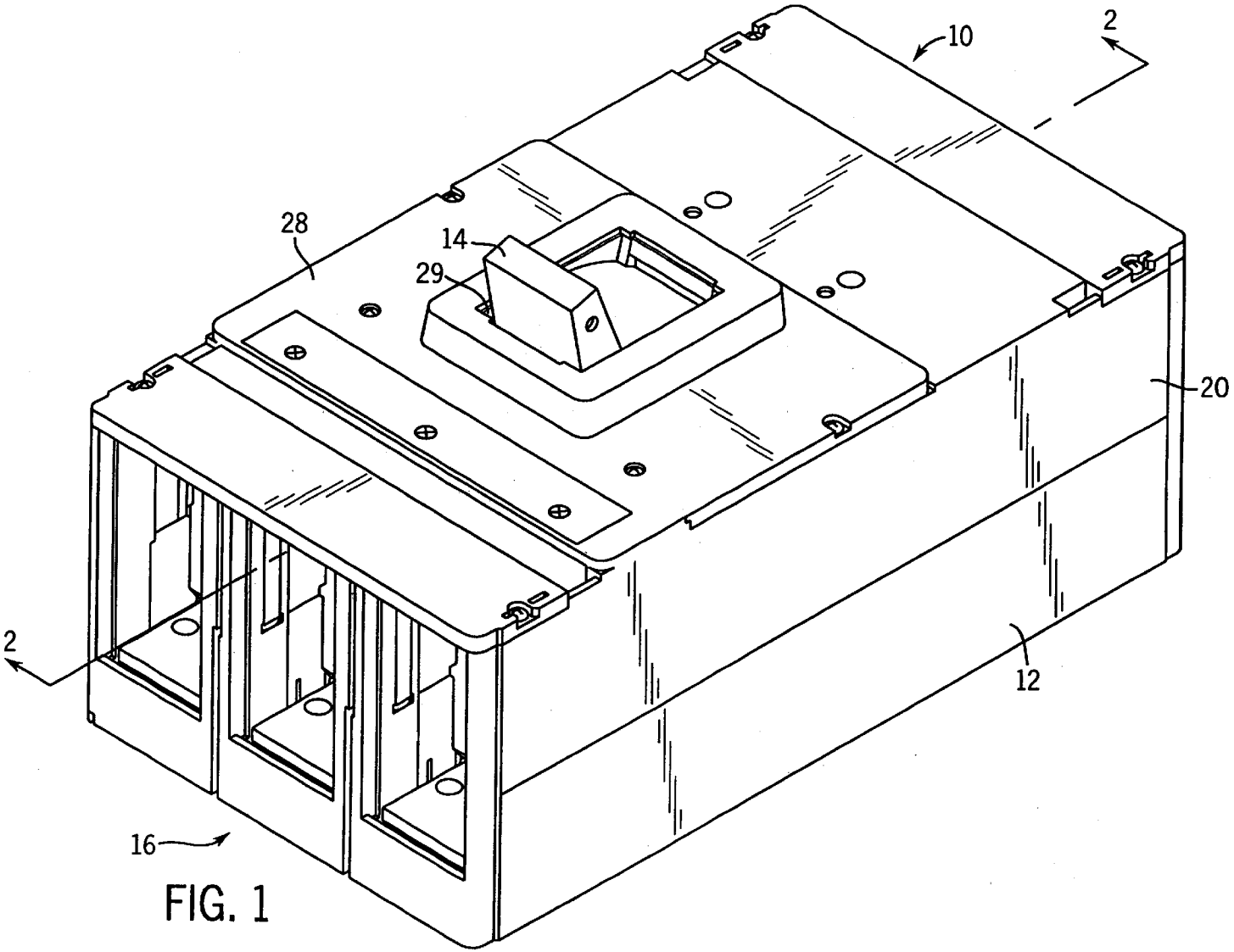
FIG. 1 is an isometric drawing of a molded case circuit breaker which includes an embodiment of the present positive "OFF" toggle mechanism.

FIG. 1 generally illustrates a three phase molded case circuit breaker 10 of the type which includes an operating mechanism 40 having a pivoting member 13 with a handle 14. The pivoting member 13 and handle 14 are moveable between an "ON" position, an "OFF" position, and a "TRIPPED" position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Circuit breaker 10 includes a positive "OFF" toggle mechanism 402, described below, which prevents handle 14 from being repositioned to an "OFF" position when the operating mechanism 40 has responded to a "TRIP" condition but, due to arcing and/or overcurrent, a movable contact 42 has inadvertently been welded to a fixed contact 44 and circuit breaker 10 therefore remains "ON."

Figure 2:
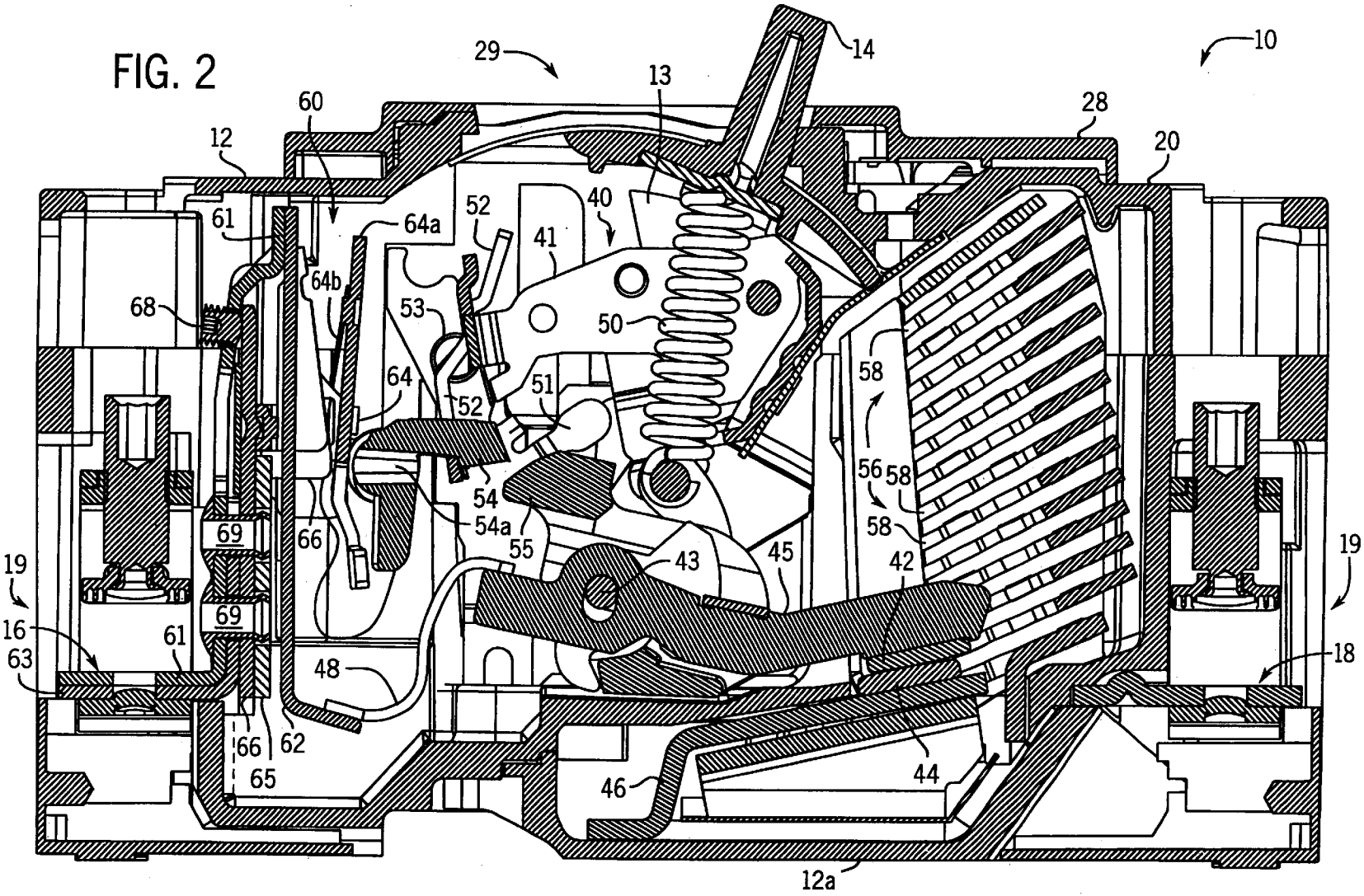
FIG. 2 is a section view of the circuit breaker shown in FIG. 1 along the lines 2—2 and is used to describe the operation of the circuit breaker.

Referring to FIG. 2, handle 14 is operable between the "ON" and "OFF" positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12*a*, a circuit breaker cover 20 and an accessory cover 28 with breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44. A trip device or trip unit 60 is mounted in the circuit breaker, 10 and coupled to the load terminal 16 and the movable contact arm 45 (see FIG. 2). The trip unit 60 includes a short circuit and thermal overload release. The short circuit release is facilitated by a magnetic element 64. The thermal overload release is facilitated by a bimetallic element 62. Further discussion of the operation of these elements is described below.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 is maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bimetallic element 62, during, for example, a long duration overcurrent condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bimetallic element 62 and from the bimetallic element 62 to the load terminal 16. (See FIG. 3) When the current flowing through the circuit breaker exceeds the rated current for the breaker, it heats the bimetallic element 62, causing the element 62 to bend towards the trip bar 54. If the over current condition persists, the bimetallic element 62 bends sufficiently to engage the trip bar surface. As the bimetallic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
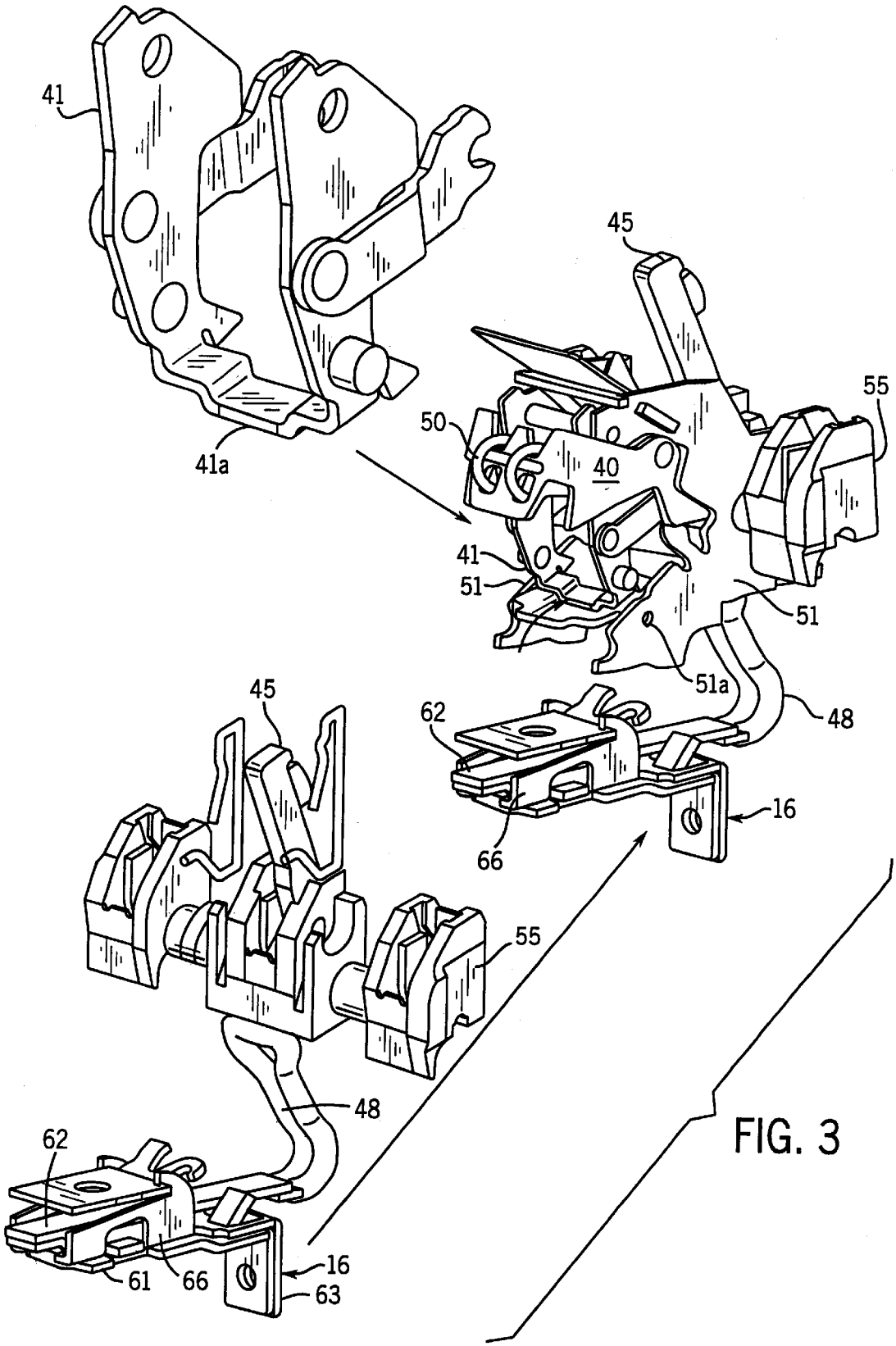
FIG. 3 is an exploded isometric drawing of the operating mechanism, contact structure, and bi-metal trip unit of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bimetallic element 62 by a flexible conductor 48 (e.g. braided copper strand). As shown in FIG. 3, current flows from the flexible conductor 48 through the bimetallic element 62 to a connection at the top of the bimetallic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41*a* which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12*a* of the circuit breaker 10.

Figure 4:
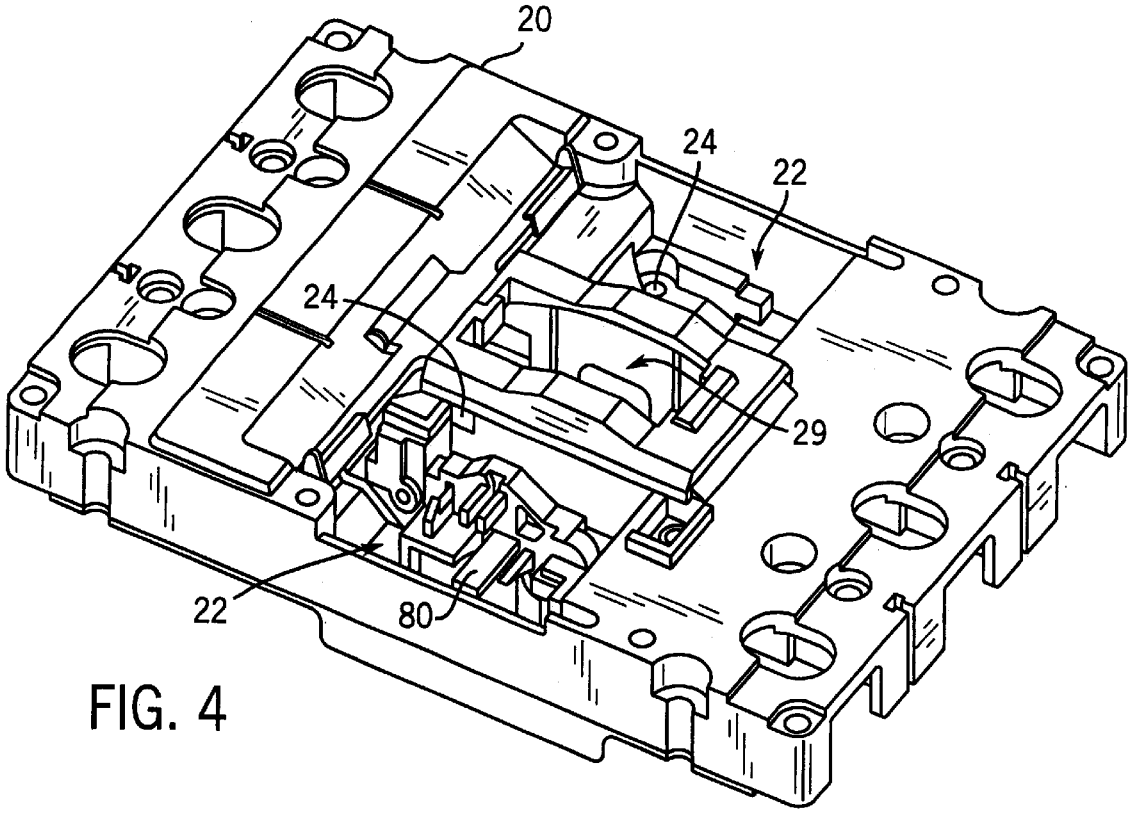
FIG. 4 is an illustration of the circuit breaker cover for the circuit breaker shown in FIG. 1.

FIG. 4 illustrates the breaker cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40. Various accessories 80 can be mounted in the accessory compartment 22 to perform various functions. Some accessories, such as a shunt trip, will trip the circuit breaker 10, upon receiving a remote signal, by pushing the trip bar 54, causing release of the mechanism latch 52 of the operating mechanism 40. The shunt trip has a member protruding through one of the openings in the accessory socket 22 and engages the operating mechanism 40, via the trip bar 54. Another accessory, such as an auxiliary switch, provides a signal indicating the status of the circuit breaker 10, e.g. "on" or "off". When the auxiliary switch is nested in the accessory socket 22, a member on the switch assembly protrudes through one of the openings 24 in the socket 22 and is in engagement with the operating mechanism 40, typically the cross bar 55. Multiple switches can be nested in one accessory socket 22 and each switch can engage the operating mechanism through a different opening 24 in the socket 22.

Figure 5:
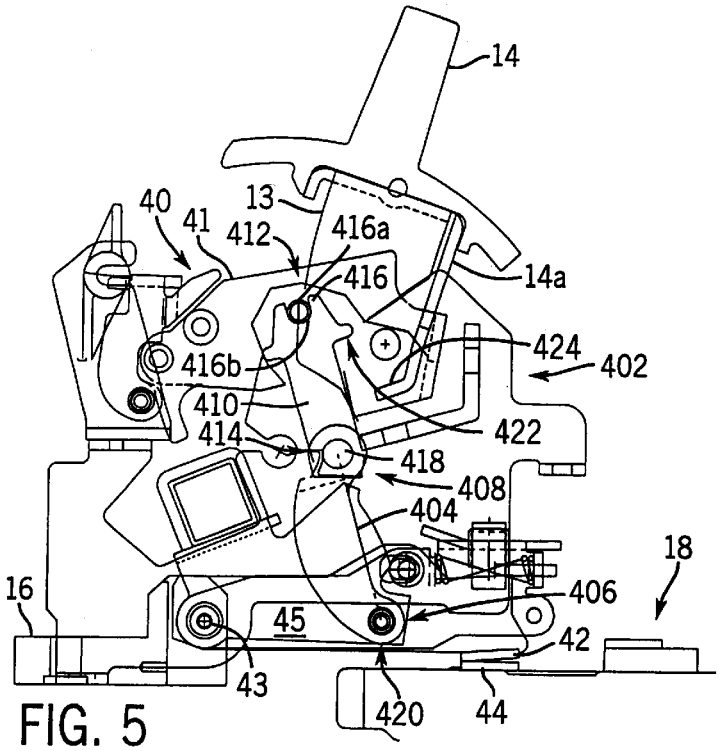
FIG. 5 is a side elevation of the circuit breaker shown in FIG. 1, wherein the contacts are operatively in an "ON" position.

FIG. 5 shows positive "OFF" toggle mechanism 402 in an "ON" condition of operation. Movable load contact 42 abuts fixed line contact 44, and electricity is thereby conducted from line terminal 18 through contact arm 45 and crossbar 55 to load terminal 16. Other devices included in circuit breaker 10 (e.g., bimetallic element 62 and braid 48, shown in FIG. 2) are deleted from FIG. 5 for clarity.

Movable contact arm 45 is pivotally secured to crossbar 55 at a pivot 43, for being repositioned between "ON," "OFF," and "TRIPPED" positions. Contact arm 45 may be placed in the "ON" position by use of handle 14, in which event an upper toggle bar 410 and a lower toggle bar 404 will be disposed in the positions shown in FIG. 5. Upper pivot 416 (which rotationally couples a first end 412 of upper bar 410 to cradle 41 of operating mechanism 40) is aligned with an intermediate pivot 418 (which rotationally couples a second end 414 of upper bar 410 to a second end 408 of lower bar 404) and with a lower pivot 420 (which rotationally couples a first end 406 of lower bar 404 to contact arm 45). The lower end of spring 50 (shown in FIG. 2) is secured to intermediate pivot 418, and biases intermediate pivot 418 against a stop (not shown) to maintain toggle mechanism 402 in stable disposition as shown. A second lower toggle bar and a second upper toggle bar configured and operated identically as the upper toggle bar 410 and the lower toggle bar 404 as described above, can be mounted on the other side of the handle 14. The symmetry of the multiple toggle bar sets on each side of the handle 14 equalizes the forces on the handle 14.

When moving contact arm to the "OFF" position by moving handle 14 to the left, spring 50 changes its angle with respect to upper bar 410 and lower bar 404 and "bends" the pair toward the left at intermediate pivot 418. Because contact arm 45 is also changing position at the same time, toggle mechanism 402 "folds" quickly and readily.

When circuit breaker 10 encounters a condition requiring breaking of the circuit (e.g., overcurrent) and trips, or is intentionally tripped by use of an accessory 80, operation of toggle mechanism 402 is essentially as described above. Handle 14 is moved to the left, contact arm 45 is moved upward and counterclockwise, and toggle mechanism 402 is folded quickly and readily.

In an overcurrent, or other circuit breaking condition, a trip device 60 repositions trip bar 54 and unlatches cradle 41. Spring 50 (shown in FIG. 2) causes cradle 41 to pivot upward. A pivot pin 416*a* of pivot 416 is affixed to cradle 41 at a notch 416*b* of first end 412 of upper bar 410, and this pulls pivot pin 416*a* out of notch 416*b*, disconnecting toggle mechanism 402 from operating mechanism 40 and handle 14. Handle 14 is moved by operating mechanism 40 to its "TRIPPED" position.

When, however, handle 14 is actuated toward the OFF position and movable contact 42 has been welded to fixed contact 44, contact arm 45 will be held in the closed position by the weld and will not open the circuit. It is highly desirable that, in that event, handle 14 not go to the "OFF" position, as the welded contacts prevent it being truly "off" but its visual "OFF" position could dangerously mislead a worker to expect power to be removed from equipment and circuits connected to load terminals 16.

Figure 6:
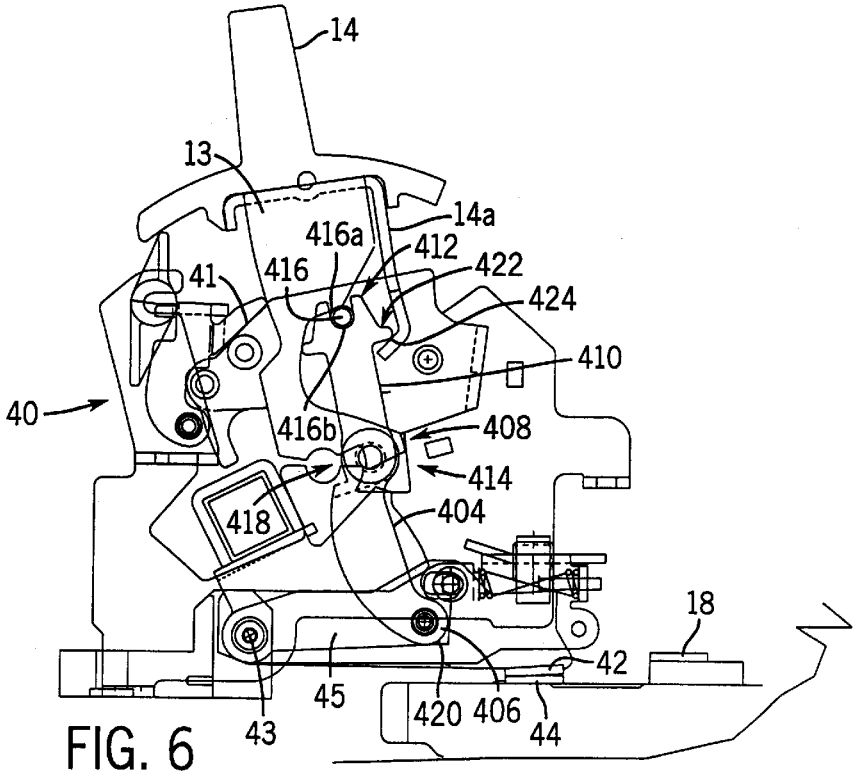
FIG. 6 is a side elevation of the circuit breaker shown in FIG. 1, wherein the contacts are welded in an "ON" position.

Therefore, upper bar 410 is provided a projecting cam finger 422 and handle 14 is provided an arm 14*a* having a cam surface 424. As shown in FIG. 6, when handle 14 is repositioned toward its "OFF" position but contact arm 45 does not rise or rotate about pivot 43 of crossbar 55, toggle mechanism 402 does not fold as quickly or completely as it otherwise would. This causes cam finger 422 to encounter and abut cam surface 424, and effectively interferes with, thereby preventing, additional travel of handle 14 toward its "OFF" position. In the preferred embodiment, pivoting member 13, handle 14, and handle arm 14*a* are one piece.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example, it is also contemplated that the trip mechanism having a bi-metal trip unit or an electronic trip unit with a load terminal be housed in a separate housing capable of mechanically and electrically connecting to another housing containing the operating mechanism and line terminal, thereby providing for a quick and easy change of current rating for an application of the circuit breaker contemplated herein. Modifications will be evident to those with ordinary skill in the art.

What is claimed is:

1. A positive OFF toggle mechanism for a molded case circuit breaker having an "ON" "OFF" and "TRIPPED" condition, with the circuit breaker including a pair of contacts one of which is coupled to an operating mechanism having a pivoting member and a handle, the positive OFF toggle mechanism comprising:

a lower toggle member having two ends, with a first end operatively coupled to the contact coupled to the operating mechanism and a second end coupled to a toggle pivot pin;

an upper toggle member having two ends, with a first end having a cam finger with a cam surface, with the first end coupled to the toggle pivot pin and a second end in operative contact with a toggle pin mounted on the operating mechanism; and, a handle arm mounted on the pivoting member of the operating mechanism, with the handle arm having a catch surface arranged to engage the cam surface of the cam finger of the first end of the upper toggle when the circuit breaker is in a welded condition and the pair of contacts remain together.

2. The toggle mechanism of claim 1, wherein the catch member is integral with the pivoting member of the operating mechanism.

3. The toggle mechanism of claim 2, wherein the upper toggle member has a cam finger with a cam surface that engages a catch surface on the catch member.

4. The positive OFF toggle mechanism of claim 1, further comprising a second lower toggle bar and second upper toggle bar mounted to the operating mechanism handle and the contact coupled to the operating mechanism, with the second lower and upper toggle bars mounted on another side of the handle.

5. A positive OFF toggle mechanism for a circuit breaker having an operating mechanism including a handle and a moveable contact arm, a trip bar, a line terminal, a load terminal and a cover, the positive OFF toggle mechanism comprising:

a lower toggle bar, having a first and a second end, with the first end pivotally coupled to the movable contact arm;

an upper toggle bar, having a first end and a second end, with the second end pivotally coupled to the second end of the lower toggle bar and with the first end of the upper toggle bar having a cam finger, a pivot pin mounted on the operating mechanism with the pivot pin aligned to engage the first end of the upper toggle bar; and, a handle arm associated with the handle, with the handle arm having a cam surface aligned to selectively engage the cam finger of the upper toggle bar when the operating mechanism is in a welded position and the movable contact arm has not moved, wherein the operating mechanism is prevented from being moved to an "OFF" position.

6. The positive OFF toggle mechanism of claim 5, wherein the movable contact arm is coupled to the load terminal.

7. The positive OFF toggle mechanism of claim 6, wherein the handle and the handle arm are one piece.

8. The positive OFFN toggle mechanism of claim 5, wherein the circuit breaker is a multi-pole circuit breaker, with the operating mechanism prevented from moving to the "OFF" position if any one movable contact arm has not moved and the operating mechanism is in a welded position.

9. The positive OFF toggle mechanism of claim 5, further comprising a second lower toggle bar and second upper toggle bar mounted to the operating mechanism handle and the moveable contact, with the second lower and upper toggle bars mounted on another side of the handle.

10. A molded case circuit breaker comprising:

a molded housing including a removable breaker cover;

a first terminal and a load terminal mounted in the case;

a contact electrically coupled to the line terminal;

a moveable contact electrically coupled to the load terminal;

an operating mechanism having a pivoting member moveable between an "ON" position, an "OFF" position and a "TRIPPED" position, wherein the pivoting member is coupled to the moveable contact;

an intermediate latching mechanism mounted in the housing and coupled to the operating mechanism;

a trip unit having a trip bar and coupled to the moveable contact and the load terminal with the trip unit in selective operative contact with the intermediate latching mechanism;

an accessory socket formed in the removable breaker cover on either side of an opening for the pivoting member; with the accessory socket in communication with the housing and configured to accept a plurality of different types of accessories;

an accessory cover sized to cover the accessory mounted in the accessory socket; and, a positive OFF toggle mechanism, the positive OFF toggle mechanism comprising:

a lower toggle bar, having a first and a second end, with the first end pivotally coupled to the movable contact arm;

an upper toggle bar, having a first end and a second end, with the second end pivotally coupled to the second end of the lower toggle bar and with the first end of the upper toggle bar having a cam finger;

a pivot pin mounted on the operating mechanism with the pivot pin aligned to engage the first end of the upper toggle bar; and, a handle arm associated with the handle, with the handle arm having a cam surface aligned to selectively engage the cam finger of the upper toggle bar when the operating mechanism is in a tripped position and the movable contact arm has not moved, wherein the operating mechanism is prevented from being reset.

11. The circuit breaker of claim 10, wherein the movable contact arm is coupled to the load terminal.

12. The circuit breaker of claim 11, wherein the handle and the handle arm are one piece.

13. The circuit breaker of claim 10, wherein the circuit breaker is a multi-pole circuit breaker, with the operating mechanism prevented from being reset if any one movable contact arm has not moved and the operating mechanism is in the tripped position.

14. The positive OFF toggle mechanism of claim 10, further comprising a second lower toggle bar and second upper toggle bar mounted to the operating mechanism handle and the moveable contact, with the second lower and upper toggle bars mounted on another side of the handle.

15. A circuit breaker comprising:

a molded housing including a base and a cover;

a means for connecting a load to the circuit breaker, mounted in the housing;

a means for connecting an electrical line to the circuit breaker;

a means for coupling electrically to the means for connecting an electrical line;

a movable means for contacting the means for connecting an electrical line to a means for operating mounted in the housing coupled with the means for operating having a pivoting member movable between an "ON" position, an "OFF" position, and a "TRIPPED" position, with the pivoting member coupled to the movable means for contacting and with the means for operating coupled to an intermediate means for latching the means for operating;

a means for tripping coupled to the movable means for contacting and the means for connecting a load with the intermediate means for latching, wherein the means for tripping includes a means for releasing under a short circuit condition and a means for releasing under an overload condition; and a means for preventing the pivoting member from moving to the OFF or a reset position when the movable means for contacting has not moved and the means for operating is in a welded position, wherein the means for preventing includes an upper togle member having two ends, with a first end having a cam finger with a cam surface, with the first end coupled to a toggle pivot pin and a second end in operative contact with a toggle pin mounted on the means for operating and a handle arm mounted on the pivoting member of the means for operating, with the handle arm having a catch surface arranged to engage the cam surface of the cam finger of the first end of the upper toggle when the circuit breaker is in a welded condition and the pair of contacts remain together.

16. The circuit breaker of claim 15 wherein the compartment includes a means for retaining the second means for tripping.

17. The circuit breaker of claim 15, further comprising a second means for tripping the circuit breaker mounted in the accessory socket and operatively connected to the means for tripping.

* * * * *